United States Patent [19]

Schneider

[11] 4,102,392

[45] Jul. 25, 1978

[54] LOW ENERGY CONSUMPTION AIR CONDITIONING SYSTEM

[76] Inventor: Theodore S. Schneider, 132 N. Clark Dr., Beverly Hills, Calif. 90211

[21] Appl. No.: 758,031

[22] Filed: Jan. 10, 1977

[51] Int. Cl.[2] ..... F25B 13/00

[52] U.S. Cl. ..... 165/62; 62/268; 62/270; 62/309; 62/310

[58] Field of Search ..... 165/62; 62/90, 268, 62/270, 309, 310, 91; 261/DIG. 11, DIG. 34, DIG. 75, 116

[56] References Cited

U.S. PATENT DOCUMENTS

| | | | |
|---|---|---|---|
| 265,256 | 10/1882 | Gamgee | 62/309 |
| 1,646,243 | 6/1923 | Handelan | 261/116 |
| 1,994,078 | 2/1933 | Sieloff | 261/116 |
| 2,096,147 | 7/1934 | Toulmin | 62/268 |
| 2,118,949 | 2/1935 | Scott | 62/309 |
| 2,183,132 | 11/1937 | Bottoms | 62/309 |
| 2,314,524 | 6/1940 | Spence | 62/270 |
| 3,680,327 | 8/1972 | Stein | 62/268 |
| 4,007,776 | 2/1977 | Alkasab | 165/18 |

*Primary Examiner*—Charles J. Myhre
*Assistant Examiner*—Margaret A. LaTulip
*Attorney, Agent, or Firm*—Robert R. Tipton

[57] ABSTRACT

An air conditioning system for building utilizes a vertically aligned, generally straight conduit rain tower for scrubbing and pumping air between the exhaust air conduit system and the supply air conduit system in conjunction with an evaporative water chiller utilizing a venturi to create a vacuum in the water chiller for low temperature vaporization of return water. Gravity flow of water through the venturi is used to create the suction head.

7 Claims, 2 Drawing Figures

LOW ENERGY CONSUMPTION AIR CONDITIONING SYSTEM

BACKGROUND OF THE INVENTION

This invention relates generally to air conditioning systems for buildings and in particular to evaporative cooling air conditioning systems.

The evaporative cooling systems of the prior art generally use a low temperature boiling coolant in a closed system in which the coolant is evaporated, to chill the coolant, which then passes through pipes which are in contact with and heated by the building air whereupon the heated vapor is then pumped back through a compressor where it is compressed, cooled and then evaporated to repeat the cycle.

Other evaporative cooling systems utilizing water consist of such apparatus commonly known as "swamp coolers" in which water is dripped over a porous medium, such as shaved wood, and air blown through whereby the air is cooled by the evaporating water.

In addition in the prior art air conditioning systems which usually comprised an air supply conduit system and an exhaust conduit system, the air is moved past the heating or cooling coils between the systems by energy consuming blowers or fans.

In such prior art systems the energy losses are generally great because of the multiplicity of energy transfer stages and the desire to move great quantities of air by conventional fan or blower means.

SUMMARY OF THE INVENTION

The apparatus of the present invention comprises basically an elongated, vertically aligned, generally straight conduit rain tower in which the chilled or heated water is caused to fall and entrain exhaust air, thus pumping it to the supply air system, and an evaporative cooling means in which a vacuum for low temperature boiling of water is created by a flow of water dropping by gravity through a venturi in which the suction inlet of the venturi is connected to the vapor chamber of the evaporative cooling apparatus.

It is therefore, an object of the present invention to provide an air conditioning system for building It is a further object of the present invention to provide an air conditioning system for a building utilizing gravity and falling water to move air in the system It is another object of the present invention to provide an air conditioning system for a building in which the air is chilled by the evaporation of water.

It is still another object of the present invention to provide an air conditioning system for a building in which a venturi provides a vacuum for evaporating and chilling water.

It is still a further object of the present invention to provide an air conditioning system for a building having a low energy consumption.

These and other objects of the present invention will be manifest upon study of the following detailed description when taken together with the drawings.

DESCRIPTION OF THE PREFERRED EMBODIMENT

Figure 1:
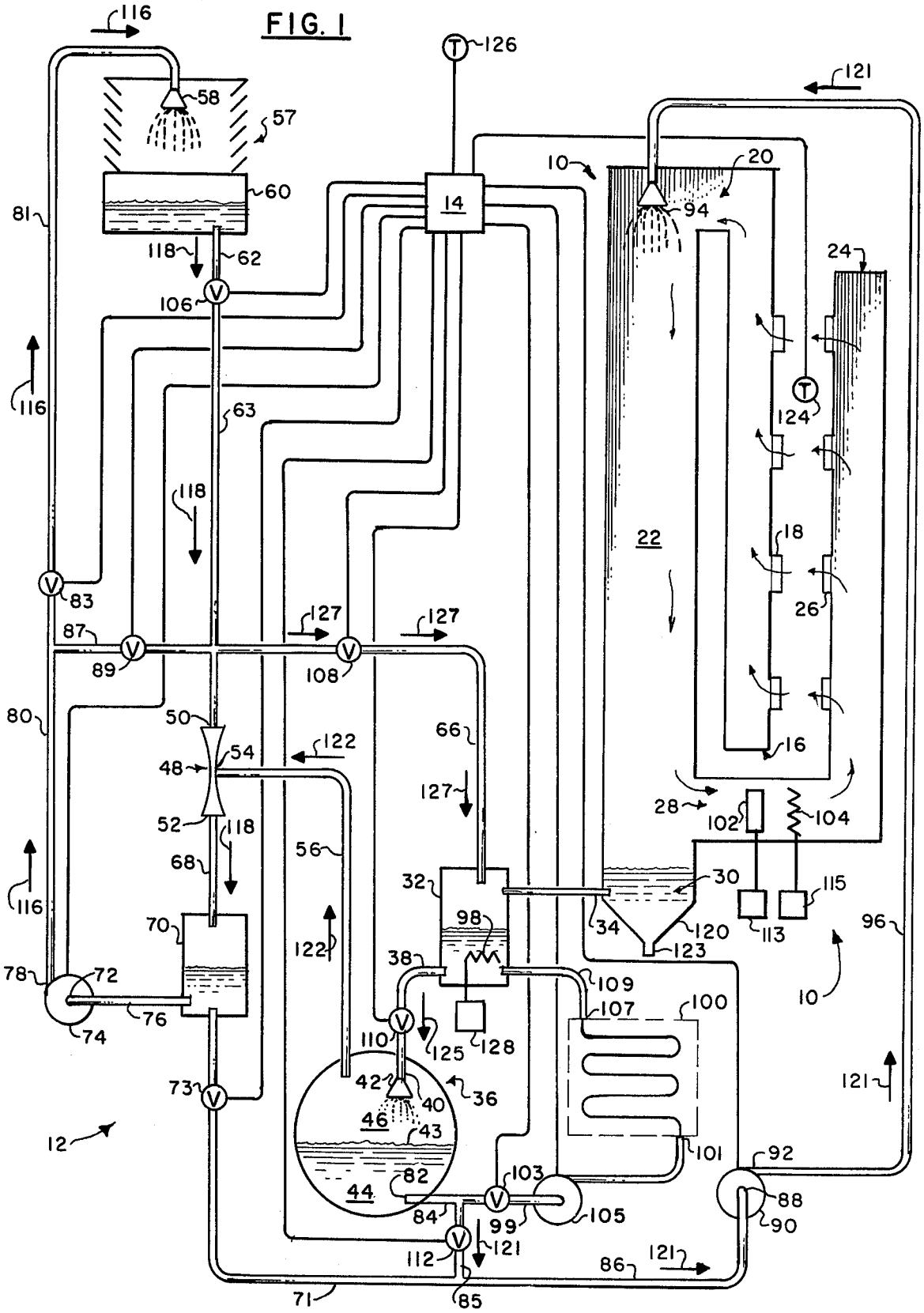
FIG. 1 is a diagrammatic illustration of the air conditioning system of the present invention for the cooling mode showing diagrammatic cross-sectional elevational views of the system.

With reference to FIG. 1 the conditioning system of present invention comprises basically an air flow system 10 connected to a heating and cooling system 12 which is controlled by a control system 14.

Air flow system 10 comprises, basically, an exhaust air conduit system 16 for a building comprising a plurality of exhaust air inlets 18 and an exhaust air outlet 20 which is in fluid communication with the upper end of elongated, vertically aligned, generally straight conduit rainfall tower 22, and a supply air conduit system 24 comprising a plurality of air outlets 26 and an air inlet 28 in fluid communication with the lower end of rainfall tower 22. At the base of rainfall tower 22 is located a catch basin 30 which is arranged at a lower level than supply air inlet 28.

Heating and cooling system 12 comprises basically a water supply tank 32 which is in fluid communication with catch basin 30 through conduit 34 and which is also in fluid communication with water chiller or evaporator 36 through conduits 38 and 40 terminating in spray nozzle 42 within chiller 36.

Water chiller 36 is arranged to be partially filled with water 43 to define a condensed water basin 44 above which is vapor volume 46.

Heating and cooling system 12 further comprises a venturi 48 having an inlet 50 and outlet in 52 and a venturi suction port 54. Venturi suction port 54 is connected through conduit 56 to vapor volume 46 of chilled water evaporater 36.

Heating and cooling system 12 also comprises an evaporative cooling tower 57 which comprises a spray nozzle 58 and a condensate recovery tank 60. The inlet end 50 of venturi 48 is connected through conduit 62, valve 106 and conduit 63 to condensate recovery tank 60. Condensate recovery tank 60 is also connected through conduits 62, valve 106, conduit 63, bypass valve 108 and bypass conduit 66 to water supply tank 32.

Outlet end 52 of venturi 48 is connected through conduit 68 to surge tank 70 which in turn is connected to inlet end 72 of pump 74 through conduit 76. The outlet end 78 of pump 74 is connected to spray nozzle 58 of cooling tower 57 through conduit 80, valve 83 and conduit 81.

The chilled water in basin 44 of water chiller 36 is connected from its chilled water outlet 82 through conduit 84, valve 112 and conduits 85 and 86 to the inlet end 88 of pump 90 whose outlet end 92 is connected to nozzle 94 proximate the top of rain tower 22 through conduit 96.

The heating portion of heating and cooling system 12 comprises, basically, a heater 98, energized by power supply 128, in water supply 32 and a supplemental heat collector panel 100, which can be either a solar collector panel or a ground or geothermal heat sink collector device. The inlet end 101 of heat collector panel 100 is connected to chilled water basin 44 by means of conduits 84 and 99, valve 103 and pump 105. The outlet end 107 of heat collector panel 100 is connected to water supply 32 through conduit 109.

Also for the heating portion of heating and cooling system 12, a conduit 87, in conjunction with valves 83 and 89 is used to bypass cooling tower 57.

Heated water is conveyed from surge tank 70, through valve 73 and conduit 71, to conduit 86 where it is pumped to rain tower 22 by means of pump 90 through conduit 96. Valve 112 is used, during the heating cycle, as a throttle valve to control the water temperature to rain tower 22 by mixing controlled amounts of chilled water from chiller 36 with the heated water from surge tank 70.

A condensate or dehydration system 102, energized by power supply 113, is located within inlet 28 of supply air system 24 in order to remove excess moisture from the incoming supply air. Such systems are common in the art and need no further description since they do not form the novel portion of the air conditioning system of the present invention. In a similar manner, an air heating apparatus 104, energized by power supply 115, is located downstream from water vapor condensing system 102 in supply air inlet 28 to raise the air temperature to the comfort zone.

A control system 14 is connected to control valves 106 in conduits 62 and 63, valve 108 in conduit 66, valve 110 in conduits 38 and 40, valve 112 in conduit 85, valve 83 in conduits 80 and 81, valve 103 in conduit 99, valve 73 in conduit 71 and valve 89 in conduit 87. Similarly, control system 14 also is connected to pumps 74, 90 and 105 which control the flow of the water in the system.

To operate the air conditioning system of the present invention in the cooling mode, reference is made to FIG. 1 in which control system 14 is set to close control valve 103 and maintain water heater 98 in the off position.

Control valves 89 and 73 are also maintained in the closed position.

Control valves 83, 106, 108, 110 and 112 are placed in the open position. Pump 74 is activated to begun pumping water from surge tank 70 to spray nozzle 58 of evaporative cooling tower 57, as indicated by arrows 116, whereby the temperature of the water coming from surge tank 70 through conduits 80 and 81 is cooled by evaporation of a portion of the water with the remainder being condensed in condensate recovery tank 60. Water from condensate recovery tank 60 then travels, as indicated by arrows 118, by gravity through conduit 62, through open control valve 106, through conduit 63, into venturi 48 at inlet 50, out through outlet 52 into conduit 68 and back through surge tank 70. Because of the action of venturi 48, a suction is created at suction port 54 causing a vacuum to be created in conduit 56 which in turn creates a vacuum in vapor volume 46 of chiller 36. Because of the lowered pressure, water being sprayed into evaporative chiller 36 by spray nozzle 42, is caused to evaporate at a low temperature whereby a portion of the condensed water is further chilled and the heat containing vapor is caused to pass up through conduit 56, as indicated by arrows 122, commingling with the water falling in conduit 68 whereupon heat is exchanged with the water flowing through venturi 48 and it is cooled again by evaporative cooling tower 57. Control valve 110 is adjusted by control system 14 to throttle the liquid coming from water supply 32, as indicated by arrows 125, through conduits 38 and 40, to maintain the proper vacuum in evaporative chiller 36. In the event there is excess water being pulled into venturi 48 and the system comprising surge tank 70, pump 74 and cooling tower 57, a bypass valve 108 is connected in conduit 66 to carry any excess water back to water supply 32 through conduit 66, as indicated by arrows 127.

When water in basin 44 of evaporative chiller 36 is lowered to a sufficient temperature, pump 90 is activated, drawing off chilled water in basin 44 through outlet 82 and into conduits 84, 85, 86 and 96 up to rain nozzle 94, as indicated by arrows 121, whereupon the water drops by gravity through raintower 22 for recovery in catch basin 30. In the process of its falling through tower 22, air is entrained to create a suction head at exhaust air system outlet 20 and a pressure head at air supply inlet 28 thus driving air into supply conduit system 24 through the building and back out into exhaust air system 16. Thus it can be seen that the need for energy consuming fans or blowers is dispensed with. It can also be seen that as the water falls in the form of droplets through raintower 22, it not only entrains the air in a downward direction but additionally cleanses the air of vapors and particulate matter. To recover the particulate matter catch basin 30 includes also a sump 120 having an outlet 123 for the purpose of periodic draining.

Both interior thermostats 124 and exterior thermostat 126 are connected to control system 14 for the purpose of adjusting for condensate loss or gain from evaporative cooling tower 56 and the pumping rate of pumps 74 and 90 to achieve adequate cooling.

Figure 2:
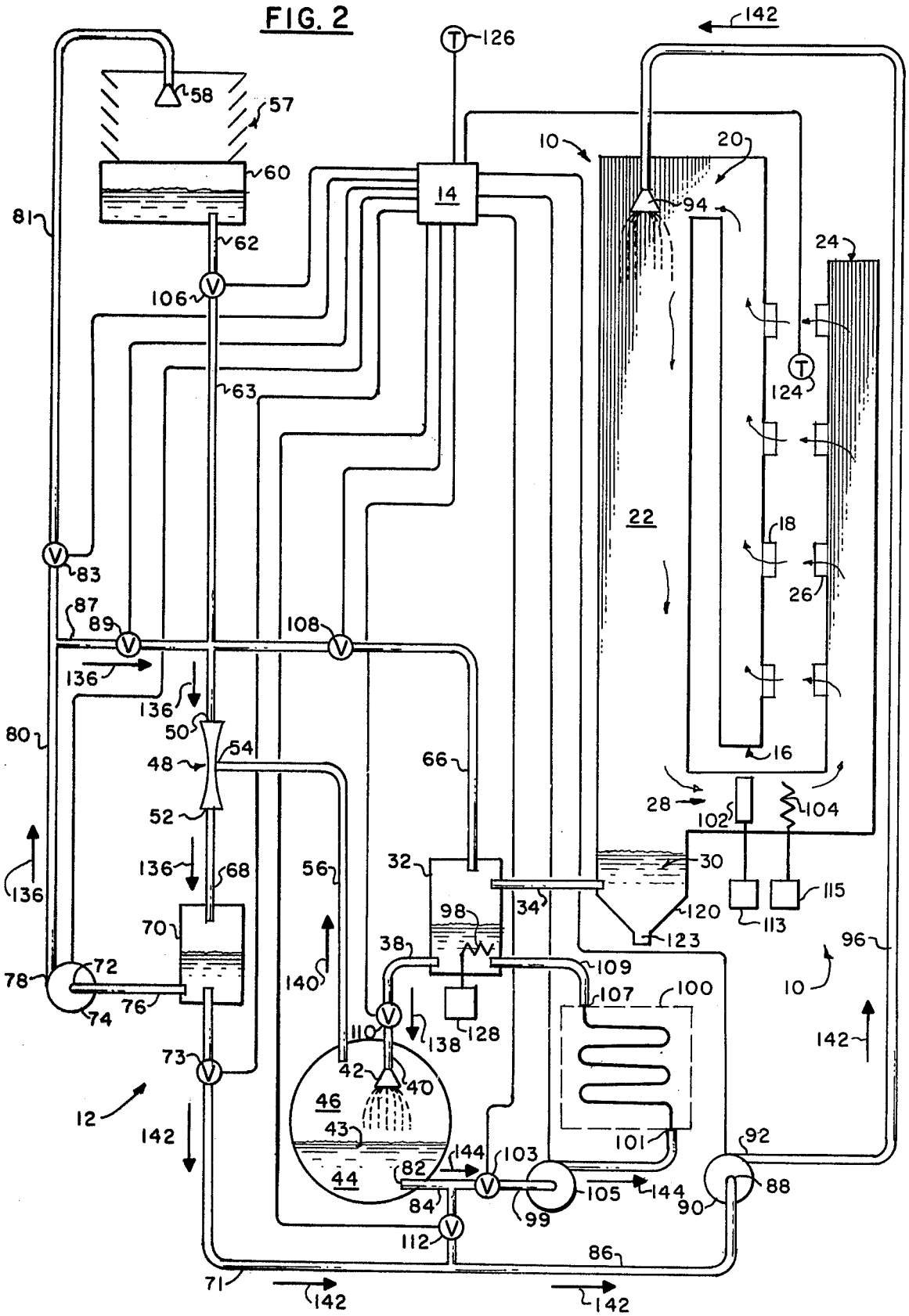
FIG. 2 is a diagrammatic illustration of the air conditioning system of the present invention for the heating mode showing diagrammatic cross-sectional elevational views of the major elements of the system.

To operate the air conditioning system of the present invention in the heating mode, reference is made to FIG. 2 in which control system 14 is used to close control valves 83, 106 and 108, while throttling valve 112 to control rain tower 22 water temperature. Valves 73, 89, 103 and 110 are maintained in the open condition.

Pump 74 is activated to begin pumping water from surge tank 70 up through conduits 80 and 87, and valve 89 to inlet end 50 of venturi 48 where the water travels, as indicated by arrows 136, by gravity through venturi 48, out through outlet end 52 into conduit 68 and back to surge tank 70.

Here again, because of the action of venturi 48, a suction is created in conduit 56 which in turn creates a vacuum in vapor volume 46 of water chiller 36. Because of the lowered pressure, water from water supply 32, as indicated by arrow 138, being sprayed into evaporative chiller 36 by spray nozzle 42, is caused to evaporate at a low temperature whereby a portion of the condensed water is further chilled and the heat containing vapor is caused to pass up through conduit 56, as indicated by arrow 140, commingling with the water falling in to conduit 68 whereby heat is exchanged with the water flowing through venturi 48.

Pump 90 is activated to cause the heated water collected in surge tank 70 to be pumped through open valve 73 and conduit 71, through conduits 86 and 96 to spray nozzle 94 at the top of rain tower 22, as indicated by arrows 142.

Here again, air is entrained with the falling water to create a suction head at exhaust air conduit system outlet 20 and a pressure head at supply air inlet 28. Simultaneously with transferring heat from the warmer water to the cooler air in tower 22, the air is further scrubbed for the removal of particulate matter.

To add thermal energy into the system, pump 105 is activated to pump chilled water from water basin 44 through heat collector 100 and back into water supply 32 as indicated by arrows 144. Because the rate of heat transfer by conduction is dependent upon the temperature difference, the use of chilled water by the present invention to utilize solar or geothermal energy is particularly effective since a high temperature gradient can be achieved.

Supplemental heat can also be added to the system using heater 98 is water supply 32 which is energized by power supply or source 128.

To sense the temperature condition of the building interior, a thermostat or temperature sensor 124 is used and is placed at a convenient location within the area of the building to be controlled.

Control is achieved, for example during the cooling mode, when an increase in temperature is detected, by increasing the pumping rate of pump 74. Similarly, if a decrease in temperature is detected by temperature sensor 124, control unit 14 would decrease the pumping rate of pump 74.

In the heating mode, the detection of an increase in temperature by temperature sensor 124 would cause control unit 14 to decrease the pumping rate of pump 74 and also cause valve 112 to open and mix chilled water with the warm water in conduit 86 being pumped to rain tower 22.

A decrease in temperature detected by temperature sensor 124 would cause control unit 14 to increase the pumping rate of pump 74 and close valve 112 to prevent chilled water from mixing with the warm water being pumped to rain tower 22.

With respect to thermostat or temperature sensor 126, this sensor is used to detect outside air temperature in order to measure the rate of cooling for cooling tower 57 or the rate of heating of heat collector 100 used as a solar energy collector and also the amount of heating or cooling required for the system based on heat loss or gain because of the temperature difference between inside and outside temperatures. Also, if collector 100 is being used as a solar energy collector, should the outside temperature plus solar heat be less than the chilled water temperature, pump 105 would then be turned off.

Thus an air conditioning system is provided having low energy consumption and fewer mechanical devices.

I claim:

1. An airconditioning system for a building comprising means defining an exhaust air conduit system for a building having a plurality of exhaust air inlets and an exhaust air outlet, means defining a supply air conduit system for a building having a plurality of supply air outlets and a supply air inlet, an elongated, vertically aligned, generally straight conduit tower adapted to contain air and water having its upper end connected to and in fluid communication with said exhaust air outlet of said exhaust air system, and having its lower end connected to and in fluid communication with said supply air inlet of said supply air system, means defining a supply of water, means for conveying said water to a location proximate the upper end of said conduit tower for free fall down said conduit tower, whereby said air flow from said exhaust air conduit system is entrained and carried downward with said flow of water and transported to said supply air inlet, means for cooling said water after falling through said conduit tower comprising, means for evaporative cooling said water having a supply water inlet nozzle, a chilled water outlet and a warm water vapor outlet, means for fluidly connecting said supply water inlet nozzle to said supply of water and said water at the bottom of said conduit tower, means for fluidly connecting said chilled water outlet to said means for conveying water to a location proximate the upper end of said conduit tower, means for creating a vacuum in said means for evaporative cooling said water comprising a venturi having an inlet end, an outlet end and a suction inlet, means for moving water through said venturi from said inlet end to said outlet end, and means for fluidly connecting said venturi suction inlet to said warm water vapor outlet of said means for evaporative cooling said water.

2. The apparatus as claimed in claim 1 wherein said means for moving water through said venturi comprises a pump having an inlet port and an outlet port, a cooling tower having a spray nozzle and means defining a water condensate tank, means for fluidly connecting said outlet end of said venturi to said inlet end of said pump means for fluidly connecting said outlet end of said pump to said spray nozzle of said cooling tower, and means for fluidly connecting said water condensate tank to said inlet end of said venturi.

3. The apparatus as claimed in claim 1 wherein said means for conveying said water to a location proximate the upper end of said conduit tower comprises a pump having an inlet end and an outlet end, a rain nozzle located proximate the upper end of said conduit tower, means for fluidly connecting said inlet end of said pump to said chilled water outlet of said means for evaporative cooling said water, and means for fluidly connecting said outlet end of said pump to said rain nozzle.

4. The apparatus as claimed in claim 1 further comprising, means for fluidly connecting said water condensate tank of said cooling tower to said supply of water, and means for controlling the flow of water from said condensate tank to said supply of water.

5. An airconditioning system for a building comprising means defining an exhaust air conduit system for a building having a plurality of exhaust air inlets and an exhaust air outlet, means defining a supply air conduit system for a building having a plurality of supply air outlets and a supply air inlet, an elongated, vertically aligned, generally straight conduit tower adapted to contain air and water having its upper end connected to and in fluid communication with said exhaust air outlet of said exhaust air system, and having its lower end connected to and in fluid communication with said supply air inlet of said supply air system, means defining a supply of water, means for conveying said water to a location proximate the upper end of said conduit tower for free fall down said conduit tower, whereby said air flow from said exhaust air conduit system is entrained and carried downward with said flow of water and transported to said supply air inlet, means for heating said water after falling through said conduit tower comprising, means for evaporative cooling said water having a supply water inlet nozzle, a chilled water outlet and a warm water vapor outlet, mean for fluidly connecting said supply water inlet nozzle to said supply of water and said water at the bottom of said conduit tower, means for creating a vacuum in said means for evaporative cooling said water comprising a ventury having an inlet end, an outlet end and a suction inlet, means for pumping water through said venturi from said inlet end to said outlet end, means for fluidly connecting said venturi suction inlet to said warm water vapor outlet of said means for evaporative cooling said water, whereby said warm water vapor is commingled with said water passing through said venturi, means defining a surge tank located to receive the flow of water from said venturi, and means for fluidly connecting said surge tank to said means for conveying water to a location proximate the upper end of said conduit rain tower.

6. The apparatus as claimed in claim 5 further comprising a heat collector panel having an inlet end and an outlet end, means for fluidly connecting said inlet end of said heat collector panel to said chilled water outlet of said means for evaporative cooling of said water, means for fluidly connecting said outlet end of said heat collector panel to said supply of water, and means for pumping said chilled water from said chilled water outlet through said heat collector panel to said supply of water.

7. The apparatus as claimed in claim 5 wherein said means for conveying said water to a location proximate the upper end of said conduit tower comprises a pump having an inlet end and an outlet end, a rain nozzle located proximate the upper end of said conduit tower, means for fluidly connecting said inlet end of said pump to said chilled water outlet of said means for evaporative cooling said water, and means for fluidly connecting said outlet end of said pump to said rain nozzle.

* * * * *